US006983635B2

(12) United States Patent
Rockholt

(10) Patent No.: US 6,983,635 B2
(45) Date of Patent: Jan. 10, 2006

(54) COIN PRESS

(76) Inventor: Rocky Rockholt, 2678 Sumac Ridge, White Bear Lake, MN (US) 55110-7001

( * ) Notice: Subject to any disclaimer, the term of this patent is extended or adjusted under 35 U.S.C. 154(b) by 28 days.

(21) Appl. No.: 10/840,914

(22) Filed: May 7, 2004

(65) Prior Publication Data

US 2005/0247096 A1 Nov. 10, 2005

(51) Int. Cl.
*B21D 43/16* (2006.01)

(52) U.S. Cl. ..... 72/428; 72/199; 72/249; 101/5; 100/176; 194/350; 194/351

(58) Field of Classification Search ..... 72/176–177, 72/182, 190–191, 196–199, 249–250, 361, 72/428; 101/5–7, 22, 36–37, 38.1; 74/1.5; 194/350–351
See application file for complete search history.

(56) References Cited

U.S. PATENT DOCUMENTS

| | | | | | |
|---|---|---|---|---|---|
| 574,227 | A | | 12/1896 | Smith | 72/421 |
| 790,462 | A | | 5/1905 | Smith | 72/333 |
| 1,153,550 | A | * | 9/1915 | Hamilton | 101/6 |
| 1,956,999 | A | | 5/1934 | Rupple | 29/60 |
| 2,819,816 | A | | 1/1958 | Moeltzner et al. | 221/183 |
| 3,105,610 | A | | 10/1963 | Aidlin et al. | 221/199 |
| 3,283,551 | A | | 11/1966 | Kraft et al. | 72/4 |
| 3,446,007 | A | * | 5/1969 | Cohen | 368/128 |
| 3,448,604 | A | | 6/1969 | Finsterwalder | 72/346 |
| 3,477,270 | A | | 11/1969 | Finsterwalder | 72/359 |
| 3,555,861 | A | | 1/1971 | Staecker, Jr. | 72/4 |
| 3,683,667 | A | | 8/1972 | Merriman et al. | 72/446 |
| 3,686,917 | A | | 8/1972 | Hikida et al. | 72/187 |
| 3,691,806 | A | | 9/1972 | Hanzawa | 72/92 |
| 3,863,485 | A | | 2/1975 | MacDonald et al. | 72/345 |
| 4,044,592 | A | | 8/1977 | Carrieri et al. | 72/462 |
| 4,172,377 | A | | 10/1979 | Shiber | 72/421 |
| 4,372,247 | A | * | 2/1983 | Calabrese | 118/116 |
| 4,549,419 | A | | 10/1985 | Trost et al. | 72/4 |
| 4,579,215 | A | * | 4/1986 | Medley, III | 194/233 |
| 5,653,141 | A | | 8/1997 | Schonau | 72/451 |
| 5,666,879 | A | | 9/1997 | Kutscher et al. | 101/3.1 |

(Continued)

FOREIGN PATENT DOCUMENTS

| | | |
|---|---|---|
| DE | 19901790 | 7/2000 |

(Continued)

*Primary Examiner*—Derris H. Banks
*Assistant Examiner*—Jimmy Nguyen
(74) *Attorney, Agent, or Firm*—Alan D. Kamrath; Nikolai & Mersereau, P.A.

(57) ABSTRACT

A coin press (10) includes a die (20) and an anvil (22) that abut and counter-rotate to nip and press a coin. The coin press (10) has a timing device (80) with a coin slot (84) and a gate (92) rotatable about a gate axis parallel to the width of the coin slot (84). The gate (92) rotates between a closed position to obstruct the coin slot (84) and an open position that allows the coin to pass gravitationally by the gate (92). A timing ring (130) rotates with one of the die (20) and the anvil (22) and has at least one lobe (132) that activates a trip lever (122) to rotate the gate (92) and gravitationally drop the coin between the anvil (22) and an image on the die (20). The die (20) and the anvil (22) are removably and replaceably mounted by sliding into a slot (46) and another slot (48) on a frame (40). First and second adjusters (62, 64) allow adjustment of pressure between the die (20) and the anvil (22).

19 Claims, 2 Drawing Sheets

U.S. PATENT DOCUMENTS

| | | | | |
|---|---|---|---|---|
| 5,950,475 | A | 9/1999 | Penny | 72/197 |
| 6,055,839 | A | 5/2000 | Hughson | 72/428 |
| 6,389,862 | B1 | 5/2002 | Kusters | 72/197 |

FOREIGN PATENT DOCUMENTS

| | | |
|---|---|---|
| GB | 2063735 | 6/1981 |
| GB | 2098525 | 11/1982 |

* cited by examiner

COIN PRESS

BACKGROUND

The present invention generally relates to coin presses and more particularly to a coin press to press an image into a coin.

The coin pressing business is 110 years old. An operator who desires a particular image inserts a coin, usually a penny, and a required currency into a coin feed mechanism. The required currency is retained in the coin press for later retrieval by an owner of the coin press. The coin is pressed between an anvil and a die. An image on the die is pressed onto one side of the coin, and the coin is generally reshaped into an oblong shape. If the coin is not centered on the image during pressing, the coin may be misshapen or the image incomplete.

Furthermore, the die and the anvil should be parallel and pressed against each other to press the coin. In removing and replacing the die and the anvil for maintenance or to change the image, the die and the anvil need to be realigned, and pressure between the die and the anvil adjusted. The process of removing, replacing, and realigning the die and the anvil to be parallel can be time consuming and inaccurate.

Therefore, there is a need to have a novel coin press to press an image onto a coin to overcome deficiencies encountered in prior coin presses.

SUMMARY

The present invention solves these needs and other problems in the field of coin pressing by providing, in a preferred form, a coin press to press a coin, such as a penny, into a shape and a design desired by an operator. The coin is pressed between a die and an anvil that abuts the die. The die and the anvil counter-rotate with respect to each other to nip and press the coin. An external surface of the die has an image which is pressed onto the coin. The coin press has a timing device with a body and a coin slot extending through the body. The coin slot has a top opening and a bottom opening, and the coin passes gravitationally through the coin slot. A width of the coin slot corresponds to a diameter of the coin. A depth of the coin slot corresponds to a thickness of the coin. The timing device also has a gate traversing the coin slot. The gate is rotatable about a gate axis parallel to the width of the coin slot. The gate rotates between an open position and a closed position. In the closed position, the gate obstructs the coin slot and constrains the coin. In the open position, the gate defines a gap, which allows the coin to pass by the gate and through the coin slot. A trip lever extends from the gate. The trip lever, when activated, rotates the gate about the axis to the open position. A timing ring rotates with one of the die or the anvil and includes at least one lobe to periodically activate the trip lever. The at least one lobe times activation of the trip lever to correspond with rotation of the die and the anvil. The trip lever rotates the gate to gravitationally drop the coin between the anvil and the image on the die. Timing of dropping of the coin facilitates nipping of an edge of the coin between the die and the anvil to center the coin on the image on the die. The nipped coin is pulled in by rotation of the die and the anvil and pressed between the anvil and the image on the die.

In other aspects of the present invention, a coin press is provided to press a coin, such as a penny, into a shape and a design desired by an operator. The coin is pressed between a die and an anvil that abuts the die. The die and the anvil counter-rotate with respect to each other to nip and press the coin. An external surface of the die has an image which is pressed onto the coin. The die has a first die bearing and a second die bearing. Similarly, the anvil has a first anvil bearing and a second anvil bearing. The coin press has a frame including a first framework and a second framework parallel and spaced from each other. The first framework has a slot that has a shape and a size to slideably receive and hold the first die bearing and the first anvil bearing. The second framework has another slot parallel to the slot in the first framework. The other slot in the second framework has a shape and a size to slideably receive and hold the second die bearing and the second anvil bearing. The anvil is mounted to the first and second frameworks by sliding the first anvil bearing into the slot of the first framework and the second anvil bearing into the other slot of the second framework. Similarly, the die is mounted adjacent the anvil by sliding the first die bearing into the slot of the first framework and the second die bearing into the other slot of the second framework. The slot and the other slot hold the anvil to the frame and allow the anvil to rotate about an anvil axis while otherwise being held stationary to the frame. Likewise, the slot and the other slot hold the die parallel the anvil and allow the die to rotate about a die axis while otherwise being held stationary to the frame. A first adjuster contacts and presses one of the first die bearing and the first anvil bearing toward the other of the first die bearing and the first anvil bearing. A second adjuster contacts and presses a respective one of the second die bearing and the second anvil bearing toward the other of the second die bearing and the second anvil bearing. Pressure from the first and second adjusters pushes the die and the anvil toward each other and holds the die and the anvil parallel and adjacent each other. The first and second adjusters allow adjustment of pressure between the die and the anvil for pressing the coin. The die and the anvil are removably and replaceably slid into the slot and the other slot of the frame for ease of assembly and maintenance of the coin press as well as ease of replacement of the image on the die. The die and the anvil are realigned by slideable mounting of the first and second die bearings and the first and second anvil bearings in the frame.

It is thus an objective of the present invention to provide a novel coin press.

It is yet another objective of the present invention to provide such a novel coin press that provides a timing device with a gate that is rotatable to an open position and activated by a timing ring that rotates with one of the die or the anvil to gravitationally drop a coin at a precise point in time so that the coin is nipped and pressed between an anvil and an image on a die.

It is yet another objective of the present invention to provide such a novel coin press that provides removable and replaceable mounting of the die and the anvil with accurate and repeatable realignment of the die and the anvil for ease of assembly and maintenance.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
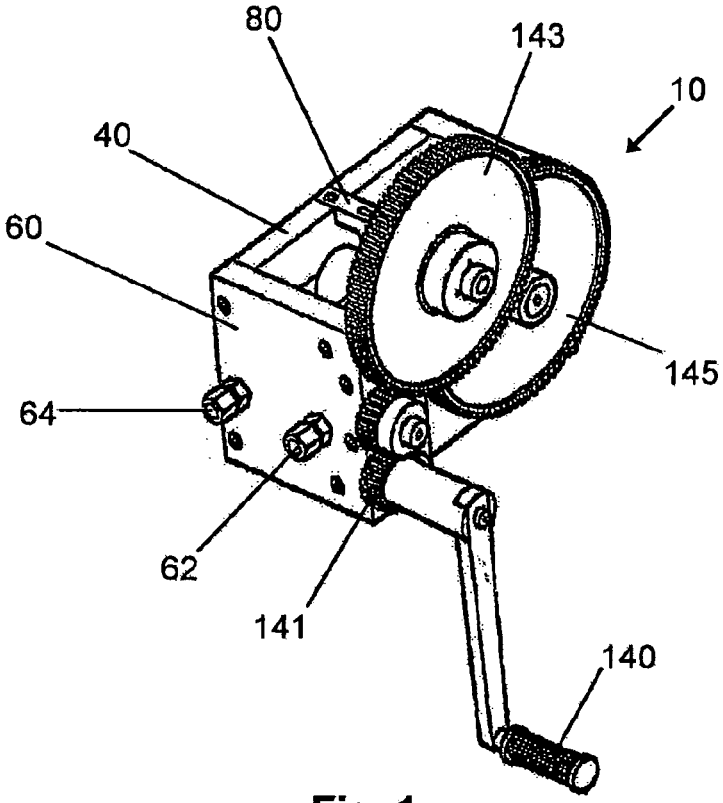
FIG. 1 shows a perspective view of a coin press according to the preferred teachings of the present invention.
Figure 3:
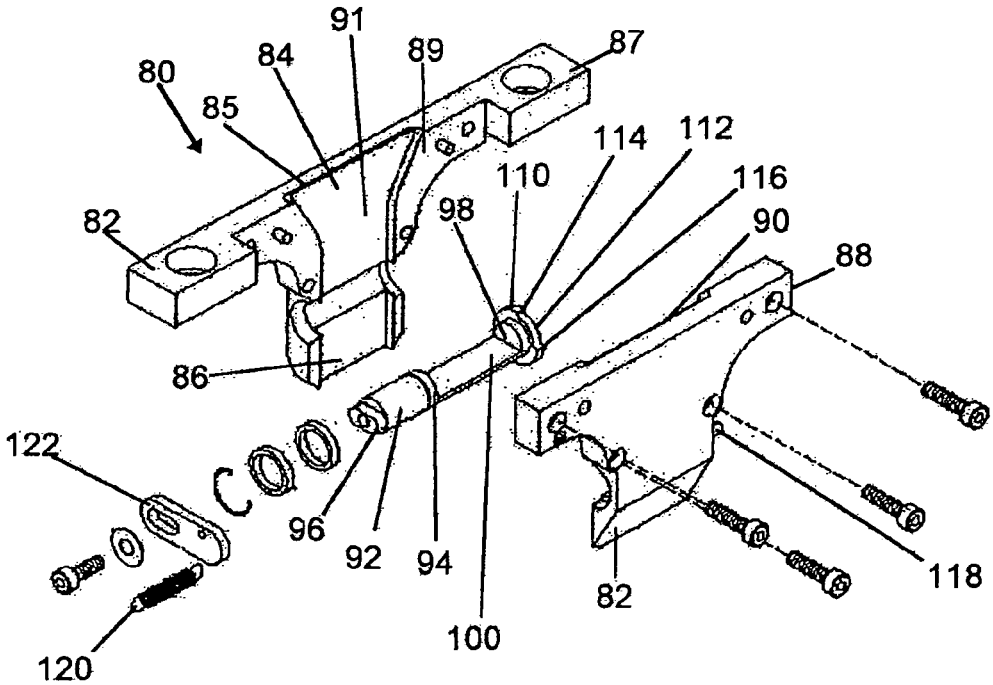
FIG. 3 shows an exploded perspective view of the timing device of the coin press of FIG. 1 according to the preferred teachings of the present invention.
Figure 2:
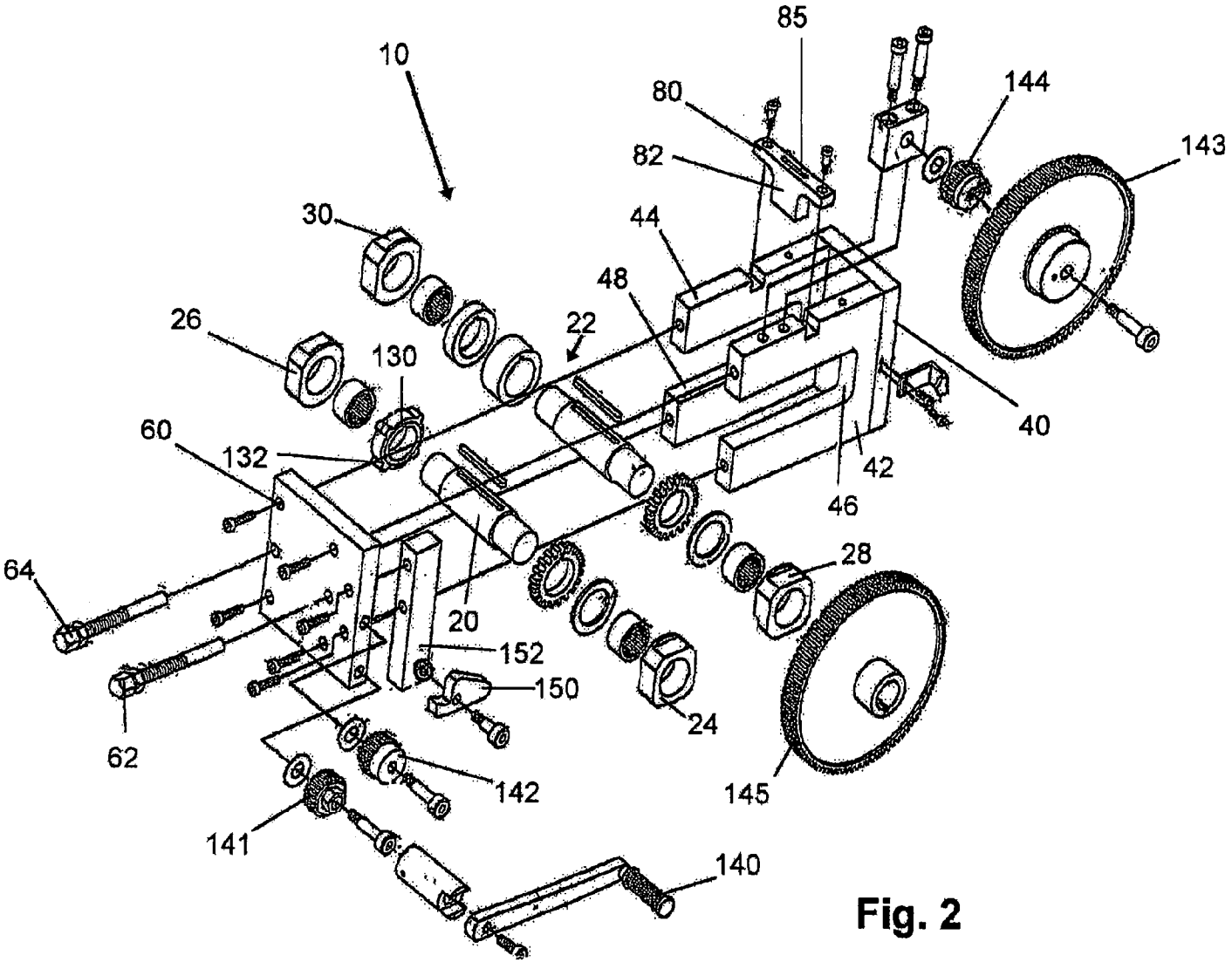
FIG. 2 shows an exploded perspective view of the coin press of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "surface," "end," "first," "second," "axis," "length," "width," "depth," "open," "closed," "top," "bottom," and similar terms are used herein, it should be understood that these terms have reference only to the structure shown in the drawings as it would appear to a person viewing the drawings and are utilized only to facilitate describing the illustrative embodiment.

DESCRIPTION OF THE PREFERRED EMBODIMENT

A coin press, constructed according to the preferred teachings of the present invention, is shown in the drawings and generally designated 10. In the most preferred form, the coin press 10 is utilized to press a coin, such as a penny, into a shape and a design desired by an operator. The coin is pressed between a die 20 and an anvil 22 that abuts the die 20. The die 20 and the anvil 22 counter-rotate with respect to each other to nip and press the coin. In the preferred form according to the teachings of the present invention, the die 20 and the anvil 22 are cylindrical. An image is received on an external surface of the die 20, and in the preferred form, the die 20 receives four images spaced equally around a circumference of the die 20 to allow the operator to select one of four different designs for pressing onto the coin.

The die 20 has a first die bearing 24 and a second die bearing 26 in the preferred form according to the teachings of the present invention. Similarly, in the preferred form, the anvil 22 has a first anvil bearing 28 and a second anvil bearing 30. In the preferred form, the coin press 10 has a frame 40 including a first framework 42 and a second framework 44. The first and second frameworks 42 and 44 are parallel and spaced from each other. The first framework 42 has a slot 46 having a shape and a size to slideably receive and hold the first die bearing 24 and the first anvil bearing 28. The second framework 44 has another slot 48 parallel to the slot 46 in the first framework 42. The other slot 48 has a shape and a size to slideably receive and hold the second die bearing 26 and the second anvil bearing 30. The anvil 22 is mounted to the first and second frameworks 42 and 44 by sliding the first anvil bearing 28 into the slot 46 of the first framework 42 and the second anvil bearing 30 into the other slot 48 of the second framework 44. Similarly, the die 20 is mounted adjacent the anvil 28 by sliding the first die bearing 24 into the slot 46 of the first framework 42 and the second die bearing 26 into the other slot 48 of the second framework 44. When mounted in the slot 46 and the other slot 48, respectively, the first anvil bearing 28 cooperates with the second anvil bearing 30 to hold the anvil 22 to the frame 40 and allow the anvil 22 to rotate about an anvil axis while otherwise being held stationary to the frame 40. Likewise, the first die bearing 24 and the second die bearing 26, when held in the slot 46 and the other slot 48, respectively, cooperate to hold the die 20 parallel to the anvil 22 and allow the die 20 to rotate about a die axis while otherwise being held stationary to the frame 40.

In the preferred form according to the teachings of the present invention, the frame 40 also includes an end plate 60 that is removably and replaceably mounted to the first and second frameworks 42 and 44. The end plate 60, in the most preferred form according to the teachings of the present invention, is rectangular and is mounted perpendicular the first and second frameworks 42 and 44 and adjacent the slot 46 and the other slot 48. The end plate 60 in the most preferred form is mounted to the first and second frameworks 42 and 44 by fasteners, such as bolts. As will be recognized by those skilled in the art, the end plate 60 could be of a different size and shape and/or the fasteners could be latches or the like, according to the teachings of the present invention.

In the preferred form according to the teachings of the present invention, a first adjuster 62 and a second adjuster 64 are provided. In the most preferred form, the first and second adjusters 62 and 64 are a first threaded bolt and a second threaded bolt that are threadably mounted through the end plate 60. The first and second adjusters 62 and 64 in the preferred form, are parallel each other and are aligned with the slot 46 and the other slot 48, respectively, when the end plate 60 is mounted to the first and second frameworks 42 and 44. The first adjuster 62 contacts and presses one of the first die bearing 24 and the first anvil bearing 28 toward the other of the first die bearing 24 and the first anvil bearing 28. The second adjuster 64 contacts and presses a respective one of the second die bearing 26 and the second anvil bearing 30 toward the other of the second die bearing 26 and the second anvil bearing 30. Pressure from the first and second adjusters 62 and 64 push the die 20 and the anvil 22 toward each other and hold the die 20 and the anvil 22 parallel and adjacent each other. The first and second adjusters 62 and 64 allow adjustment of pressure between the die 20 and the anvil 22 for pressing the coin. According to the teachings of the present invention, the first adjuster 62 and the second adjuster 64 could have different mountings or orientations or could be formed by clamps or the like, without departing from the spirit or scope of the present invention.

Removably and replaceably sliding the die 20 and the anvil 22 into the slot 46 and the other slot 48 of the frame 40 allows ease of assembly and maintenance of the coin press 10 as well as ease of replacement of the image on the die 20. The die 20 and the anvil 22 are realigned by slideable mounting of the first and second die bearings 24 and 26 and the first and second anvil bearings 28 and 30 into the frame 40. As will be recognized by those skilled in the art, the die 20 could be mounted into the slot 46 and the other slot 48 either before or after mounting of the anvil 22 according to the teachings of the present invention. Likewise, the anvil 22 could be supplied with another image corresponding to the image of the die 20 to press into a second side of the coin without departing from the spirit or scope of the present invention.

In the preferred form according to the teachings of the present invention, the coin press 10 has a timing device 80 mounted intermediate the first and second frameworks 42 and 44 by receipt of its opposite ends in notches formed in the top edges of frameworks 42 and 44. The timing device 80 has a body 82 and a coin slot 84 extending through the body 82. The coin slot 84 has a top opening 85 and a bottom opening 86 and the coin passes gravitationally through the coin slot 84. A width of the coin slot 84 corresponds to a diameter of the coin. A depth of the coin slot 84 corresponds to a thickness of the coin. The body 82 of the timing device 80, in the most preferred form, is made of metal, such as aluminum, and is formed by a first section 87 and a second section 88. The first section 87 has a notched portion 89 extending from the top opening 85 to the bottom opening 86. The notched portion 89 is shaped to receive the second section 88. The coin slot 84 has rectangular cross sections and is intermediate the first and second sections 87 and 88. The second section 88 mounts within the notched portion 89 and defines an internal wall 90 of the coin slot 84. A channel 91 is defined in the notched portion 89, and the channel 91 defines three walls of the coin slot 84. The timing device 80 is mounted to the frame 40 so that the bottom opening 86 of the coin slot 84 is above and proximate the abutment of the die 20 and the anvil 22. The body 82 of the timing device 80 narrows in width and depth toward the bottom opening 86 of the coin slot 84 to facilitate locating the bottom opening 86 proximate and between the die 20 and the anvil 22. The proximity of the bottom opening 86 to the die 20 and the anvil 22 facilitates dropping of the coin between the die 20 and the anvil 22.

The timing device 80 also has a gate 92 traversing the coin slot 84. The gate 92 is rotatable about a gate axis parallel to the width of the coin slot 84 and in the preferred form is formed of metal, such as aluminum. The gate 92 rotates about the gate axis between an open position and a closed position. In the closed position, the gate 92 obstructs the coin slot 84 and constrains the coin. In the open position, the gate 92 defines a gap which allows the coin to pass by the gate 92 and through the coin slot 84.

In the most preferred form according to the teachings of the present invention, the gate 92 in the timing device 80 has a shaft 94 intermediate a first end 96 and a second end 98. A notch 100 extending from an external surface of the shaft 94 inwards to the gate axis defines the gap in the gate 92 of the most preferred form. The notch 100 has a length parallel to and at least as long as the width of the coin slot 84, and the notch 100 defines a generally semi-cylindrical shape of the shaft 94. In the most preferred form, the gate axis is coplanar with the internal wall 90 of the coin slot 84, and the gate 92 is clear of the coin slot 84 when rotated to the open position. The second end 98 of the gate 92, in the most preferred form, has a flange 110 external the body 82 of the timing device 80. The flange 110 has an external circumference and an indentation 112 on the external circumference. The indentation 112 defines and is intermediate a first stop 114 and a second stop 116. The timing device 80, in the most preferred form, has a peg 118 extending external the body 82 of the timing device 80 and adjacent the indentation 112 such that rotation of the gate 92 is limited to an arc between the first stop 114 and the second stop 116. In other words, rotation of the gate 92 in a first direction toward the open position is limited by the first stop 114 abutting the peg 118. Likewise, rotation of the gate 92 opposite the first direction is limited by the second stop 116 abutting the peg 118.

In the preferred form according to the teachings of the present invention, the gate 92 is biased and, in the most preferred form, the gate 92 is biased toward the closed position. A spring 120, in the most preferred form, is connected to the first end 96 of the gate 92 to bias the gate 92 toward the closed position.

A trip lever 122 for the gate 92 is provided in the preferred form according to the teachings of the present invention and extends radially from the first end 96 of the gate 92. The trip lever 122 is exterior the body 82 of the timing device 80 and in the preferred form, is formed of metal, such as aluminum. When activated, the trip lever 122 in the preferred form rotates the gate 92 to the open position. Alternately, the gate 92 could be biased toward the open position and could be moved by activation of the trip lever 122 to the closed position without departing from the spirit or scope of the present invention. In the most preferred form, the spring 120 has a first end attached to the trip lever 122 radially from the gate axis and a second end attached to the body 82.

In the preferred form according to the teachings of the present invention, a timing ring 130 is provided that rotates with one of the die 20 or the anvil 22. At least one lobe 132 is defined on the timing ring 130 and extends radially from the timing ring 130 in the preferred form. The at least one lobe 132 periodically activates the trip lever 122 on the gate 92 as the timing ring 130 rotates. Timing of activation of the trip lever 122 by the at least one lobe 132 is synchronized with rotation of the die 20 and the anvil 22 to release and gravitationally drop the coin between the anvil 22 and the image on the die 20 at a precise point in time.

In the preferred form, the at least one lobe 132 and the images on the die 20 are placed at angles to a keyway for receiving a key extending from the shaft for the die 20. The coin dropping at the precise point in time ensures that an edge of the coin is nipped between the anvil 22 and the die 20 to center the coin on the image on the die 20 to facilitate pressing of the coin between the anvil 22 and the image on the die 20. In the most preferred form, the timing ring 130 has four lobes 132 spaced equally and extending radially from the timing ring 130. In the most preferred form, the timing ring 130 is spaced from the trip lever 122 such that during rotation of the timing ring 130 only the four lobes 132 contact the trip lever, and in between the four lobes 132, the trip lever 122 is not activated and the gate 92 remains in the closed position. The four lobes 132 contact and time activation of the trip lever 122 to open the gate 92 and gravitationally drop the coin between the anvil 22 and one of the four images on the die 20 to facilitate nipping and centering of the coin on one of the four images on the die 20 for pressing the coin. After pressing, the coin is gravitationally released by further rotation of the die 20 and the anvil 22.

In the most preferred form according to the teachings of the present invention, the gate 92 is biased to the closed position, and the at least one lobe 132 extends radially outward from the timing ring 130 and contacts the trip lever 122 to rotate the gate 92 to the open position. Alternately, in accordance with the teachings of the present invention, the gate 92 could be biased to the open position such that when the at least one lobe 132 contacts the trip lever 122, the gate 92 is rotated to the closed position to restrain the coin. Upon further rotation of the timing ring 130, the at least one lobe 132 in the alternate example, moves away from the trip lever 122 to allow the gate 92 to return to the open position and release the coin.

According to the teachings of the present invention, a crank handle 140 and a gear train 142, 143 and 144 are provided in the preferred form. The crank handle 140 is rotatable and can be manually turned by an operator, external the coin press 10. A gear 141 is provided on the crank handle 140 in the preferred form and rotates with the crank handle 140. The gear train 142, 143 and 144 mechanically links the gear 141 of the crank handle 140 to another gear 145 on one of the die 20 and the anvil 22 and provides gear reduction between the gear 141 and the other gear 145 to increase mechanical advantage while rotating the one of the die 20 and the anvil 22. The one of the die 20 and the anvil 22 is geared to the other of the die 20 and the anvil 22 to counter-rotate the die 20 and the anvil 22. Also, in the preferred form, a ratchet 150 is mounted to a block 152 proximate the crank handle 140. In the most preferred form according to the teachings of the present invention, the block 152 is mounted to the end plate 60 of the frame 40. The ratchet 150 engages the gear 141 of the crank handle 140 to limit rotation of the crank handle 140 to a single direction.

Now that the basic teachings of the present invention have been explained, many extensions and variations will be obvious to one having ordinary skill in the art. For example, although the coin press 10 according to the preferred teachings of the present invention has been shown as including several features in combination believed to produce synergistic results, such features can be utilized singly and in other combinations with other features according to the teachings of the present invention. For example, although according to the teachings of the present invention, the coin press 10 with the timing device 80 and with removability and replaceability of the die 20 and the anvil 22 in combination provides ease of assembly and operation with minimal downtime, the coin press 10 may be used with the timing device 80 but without the die 20 and the anvil 22 being slideably removable and replaceable in a manner of the preferred form shown. Similarly, the coin press 10 may be used with slideable removability and replaceability of the die 20 and the anvil 22 of the preferred form shown, but without the timing device 80 without departing from the spirit or scope of the present invention.

Likewise, although the timing device 80, trip lever 122 and gate 92 in the preferred form are formed of metal, such as aluminum, which is advantageous for being strong and lightweight, the timing device 80, trip lever 122 and gate 92 could be formed of another material, such as but not limited to plastic or the like, without departing from the spirit or scope of the present invention.

Similarly, although in the preferred form a crank handle 140 is provided for manual turning by an operator, the die 20 and the anvil 22 could be rotated by other methods, such as, but not limited to, a motor or the like, without departing from the spirit or scope of the present invention.

Thus since the invention disclosed herein may be embodied in other specific forms without departing from the spirit of general characteristics thereof, some of which forms have been indicated, the embodiment described herein is to be considered in all respects illustrative and not restrictive. The scope of the invention is to be indicated by the appended claims, rather than by the foregoing description, and all changes, which come within the meaning, and ranges of equivalency of the claims are intended to be embraced therein.

What is claimed is:

1. A coin press comprising, in combination:

a frame including a first framework and a second framework spaced and parallel the first framework;

a die having a first die bearing and a second die bearing, with the die adapted to receive an image on an external surface of the die;

an anvil having a first anvil bearing and a second anvil bearing;

a slot in the first framework, with the slot having a shape and a size to slideably receive and hold the first die bearing and the first anvil bearing, with the first die bearing and the first anvil bearing being removable and replaceable in the slot;

another slot in the second framework, with the other slot being parallel the slot of the first framework and having a shape and a size to slideably receive and hold the second die bearing and the second anvil bearing, with the second die bearing and the second anvil bearing being removable and replaceable in the other slot, with the first die bearing and the first anvil bearing when held in the slot cooperating with the second die bearing and the second anvil bearing when held in the other slot to hold the die and the anvil to the frame, with the die when held to the frame being rotatable about a die axis and otherwise held stationary relative to the frame, with the anvil when held to the frame being rotatable about an anvil axis parallel the die axis, with the anvil otherwise held stationary relative to the frame, with the die and the anvil being in abutting counter-rotation to each other when held to the frame;

a timing device including a body and a coin slot extending through the body, with the coin slot having a top opening and a bottom opening, with the coin slot adapted to allow the coin to pass gravitationally through the coin slot, with the coin slot having a width corresponding to a diameter of the coin and a depth corresponding to a thickness of the coin;

a gate in the timing device and rotatable about a gate axis between an open position and a closed position, with the gate axis being parallel to the width of the coin slot, with the gate in the closed position obstructing the coin slot to constrain the coin in the coin slot, with the gate in the open position defining a gap that allows the coin to pass by the gate and through the coin slot when the gate is rotated to the open position;

a trip lever extending from the gate exterior the body of the timing device, with the trip lever when activated rotating the gate to time release of the coin from the coin slot, with the die and the anvil located below and proximate the bottom opening of the coin slot, with the die and the anvil cooperating to nip the coin between the die and the anvil when the coin is released from the coin slot; and a timing ring defining at least one lobe, with the timing ring rotatable with one of the die and the anvil, with rotation of the timing ring causing the at least one lobe to periodically activate the trip lever of the timing device to rotate the gate, with timing of activation of the trip lever synchronized with rotation of the die and the anvil to release and gravitationally drop the coin, with the coin being released at a precise point in time to facilitate nipping of an edge of the coin between the anvil and the die and to center the coin on the image on the die, with the nipped coin being pulled in and pressed between the die and the anvil by rotation of the die and the anvil, with the coin being pressed into the shape and the design defined by the image on the die, with the coin after pressing gravitationally released by further rotation of the die and the anvil.

2. The coin press of claim 1 with the body of the timing device comprising:

a first section having a notched portion extending from the top opening to the bottom opening, with the notched portion defining a channel; and a second section mounted within the notched portion of the first section, with the coin slot having rectangular cross sections and being intermediate the first section and the second section, with the second section defining an internal wall of the coin slot, with the channel in the notched portion of the first section defining three walls of the coin slot, with the body of the timing device narrowing in width and depth toward the bottom opening of the coin slot to facilitate locating the bottom opening proximate and between the die and the anvil.

3. The coin press of claim 1 with the at least one lobe of the timing ring extending radially outward from the timing ring, with the gate being biased toward the closed position, with the trip lever when activated by the at least one lobe rotating the gate to the open position.

4. The coin press of claim 1 further comprising, in combination:

a first adjuster contacting one of the first die bearing and the first anvil bearing, with the first adjuster pressing the one of the first die bearing and the first anvil bearing toward the other of the first die bearing and the first anvil bearing; and a second adjuster contacting a respective one of the second die bearing and the second anvil bearing and pressing the respective one of the second die bearing and the second anvil bearing toward the other of the second die bearing and the second anvil bearing, with the first adjuster and the second adjuster cooperating to press and hold the die and the anvil parallel and adjacent each other, with the first adjuster and the second adjuster allowing adjustment of pressure between the die and the anvil.

5. A coin press to press a coin into a shape and a design, with the coin press comprising, in combination:

a timing device including a body and a coin slot extending through the body, with the coin slot having a top opening and a bottom opening, with the coin slot adapted to allow the coin to pass gravitationally through the coin slot, with the coin slot having a width corresponding to a diameter of the coin and a depth corresponding to a thickness of the coin;

a gate in the timing device and rotatable about a gate axis between an open position and a closed position, with the gate axis being parallel to the width of the coin slot, with the gate in the closed position obstructing the coin slot to constrain the coin in the coin slot, with the gate in the open position defining a gap that allows the coin to pass by the gate and through the coin slot when the gate is rotated to the open position;

a trip lever extending from the gate exterior the body of the timing device, with the trip lever when activated rotating the gate to time release of the coin from the coin slot;

a die rotatable about a die axis and adapted to receive an image on an external surface of the die;

an anvil rotatable about an anvil axis, with the anvil axis being parallel the die axis, with the die and the anvil being in abutting counter-rotation and located below and proximate the bottom opening of the coin slot, with the die and the anvil cooperating to nip the coin between the die and the anvil when the coin is released from the coin slot; and a timing ring defining at least one lobe, with the timing ring rotatable with one of the die and the anvil, with rotation of the timing ring causing the at least one lobe to periodically activate the trip lever of the timing device to rotate the gate, with timing of activation of the trip lever synchronized with rotation of the die and the anvil to release and gravitationally drop the coin, with the coin being released at a precise point in time to facilitate nipping of an edge of the coin between the anvil and the die and to center the coin on the image on the die, with the nipped coin being pulled in and pressed between the die and the anvil by rotation of the die and the anvil, with the coin being pressed into the shape and the design defined by the image on the die, with the coin after pressing gravitationally released by further rotation of the die and the anvil.

6. The coin press of claim 5 with the timing ring having four lobes extending radially from the timing ring, with the four lobes being equally spaced around the timing ring, with the die adapted to receive four images on the external surface, with the four images being equally spaced around a circumference of the die, with timing of activation of the trip lever by one of the four lobes synchronized with rotation of the die and the anvil to facilitate nipping of the coin between the anvil and the die and to center the coin on one of the four images on the die to facilitate pressing the one of the four images onto the coin.

7. The coin press of claim 5 with the gate biased to the closed position and with the lobe of the at least one timing ring periodically contacting and activating the trip lever, with the trip lever when activated rotating the gate to the open position to release the coin.

8. The coin press of claim 7 further comprising, in combination:

a flange on the gate exterior the body of the timing device, with the flange having an external circumference;

an indentation defined on the external circumference of the flange of the gate, with the indentation intermediate and defining a first stop and a second stop on the external circumference; and a peg defined on the body of the timing device, with the peg being exterior the body and extending adjacent the indentation in the flange of the gate, with rotation of the gate limited by the peg to an arc between the first stop and the second stop, with rotation of the gate in a first direction being toward the open position and limited by the first stop abutting the peg, with rotation of the gate opposite the first direction limited by the second stop abutting the peg, with the gate when the second stop abuts the peg being in the closed position.

9. The coin press of claim 8 with the gate having a shaft, a first end and a second end, with the shaft being intermediate the first end and the second end, with the gap being defined by a notch extending from an external surface of the shaft inwards to the gate axis and defining a semi-cylindrical shape of the shaft, with the notch having a length parallel the gate axis and at least as long as a width of the coin slot, with the gate when rotated to the open position allowing the coin to pass the gate via the notch, with the trip lever extending radially from the first end of the gate and with the flange being on the second end of the gate.

10. The coin press of claim 9 with the gate axis being coplanar with an internal wall of the coin slot, with the gate in the open position being clear of the coin slot.

11. The coin press of claim 5 further comprising, in combination:

a crank handle rotatable and adapted for manual use by an operator, with the crank handle having a gear rotatable with the crank handle;

a ratchet engaging the gear of the crank handle to limit rotation of the crank handle to a single direction; and a gear train mechanically linking the gear of the crank handle to another gear on one of the die and the anvil, with the gear train providing gear reduction between the gear of the crank handle and the other gear of the one of the die and the anvil while rotating the one of the die and the anvil, with the one of the die and the anvil geared to the other of the die and the anvil to counter-rotate the die and the anvil when the crank handle is rotated by the operator.

12. The coin press of claim 11 further comprising a block mounted to the end plate, with the ratchet being mounted to the block.

13. The coin press of claim 5 with the die and the anvil each being cylindrical.

14. The coin press of claim 5 with the body of the timing device comprising:

a first section having a notched portion extending from the top opening to the bottom opening, with the notched portion defining a channel; and a second section mounted within the notched portion of the first section, with the coin slot having rectangular cross sections and being intermediate the first section and the second section, with the second section defining an internal wall of the coin slot, with the channel in the notched portion of the first section defining three walls of the coin slot, with the body of the timing device narrowing in width and depth toward the bottom opening of the coin slot to facilitate locating the bottom opening proximate and between the die and the anvil.

15. The coin press of claim 5 with the at least one lobe of the timing ring extending radially outward from the timing ring, with the gate being biased toward the closed position, with the trip lever when activated by the at least one lobe rotating the gate to the open position.

16. A coin press comprising, in combination:

a frame including a first framework and a second framework spaced and parallel the first framework;

a die having a first die bearing and a second die bearing, with the die adapted to receive an image on an external surface of the die;

an anvil having a first anvil bearing and a second anvil bearing;

a slot in the first framework, with the slot having a shape and a size to slideably receive and hold the first die bearing and the first anvil bearing, with the first die bearing and the first anvil bearing being removable and replaceable in the slot;

another slot in the second framework, with the other slot being parallel the slot of the first framework and having a shape and a size to slideably receive and hold the second die bearing and the second anvil bearing, with the second die bearing and the second anvil bearing being removable and replaceable in the other slot, with the first die bearing and the first anvil bearing when held in the slot cooperating with the second die bearing and the second anvil bearing when held in the other slot to hold the die and the anvil to the frame, with the die when held to the frame being rotatable about a die axis and otherwise held stationary relative to the frame, with the anvil when held to the frame being rotatable about an anvil axis parallel the die axis, with the anvil otherwise held stationary relative to the frame, with the die and the anvil being in abutting counter-rotation to each other when held to the frame;

a crank handle rotatable and adapted for manual use by an operator, with the crank handle having a gear rotatable with the crank handle;

a gear train mechanically linking the gear of the crank handle to another gear on the one of the die and the anvil, with the gear train providing gear reduction between the gear of the crank handle with the other gear of the one of the die and the anvil while rotating the one of the die and the anvil, with the one of the die and the anvil geared to the other of the die and the anvil to counter-rotate the die and the anvil when the crank handle is rotated by the operator;

an end plate mounted to the first and second frameworks;

a block mounted to the end plate proximate the crank handle; and a ratchet mounted to the block, with the ratchet engaging the gear of the crank handle to limit rotation of the crank handle to a single direction.

17. The coin press of claim 16 further comprising, in combination:

a first adjuster contacting one of the first die bearing and the first anvil bearing, with the first adjuster pressing the one of the first die bearing and the first anvil bearing toward the other of the first die bearing and the first anvil bearing; and a second adjuster contacting a respective one of the second die bearing and the second anvil bearing and pressing the respective one of the second die bearing and the second anvil bearing toward the other of the second die bearing and the second anvil bearing, with the first adjuster and the second adjuster cooperating to press and hold the die and the anvil parallel and adjacent each other, with the first adjuster and the second adjuster allowing adjustment of pressure between the die and the anvil.

18. The coin press of claim 17 wherein the end plate is removably and replaceably mounted to the first and second frameworks, with the end plate being rectangular, perpendicular the first and second frameworks, and adjacent the slot and the other slot when mounted to the frame, with the first adjustor comprising a first threaded bolt and the second adjustor comprising a second threaded bolt, with the first threaded bolt and the second threaded bolt being threadably mounted through the end plate parallel each other and aligned with the slot and the other slot, respectively, when the end plate is mounted to the first and second frameworks.

19. The coin press of claim 16 with a timing device intermediate and mounted to the first and second frameworks.

* * * * *